US007332020B2

(12) United States Patent
Tanaka et al.

(10) Patent No.: US 7,332,020 B2
(45) Date of Patent: Feb. 19, 2008

(54) GAS TREATING DEVICE

(75) Inventors: Toshio Tanaka, Sakai (JP); Kanji Motegi, Sakai (JP); Kenkichi Kagawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 204 days.

(21) Appl. No.: 10/569,432

(22) PCT Filed: Jun. 22, 2004

(86) PCT No.: PCT/JP2004/009094

§ 371 (c)(1),
(2), (4) Date: Feb. 23, 2006

(87) PCT Pub. No.: WO2005/021160

PCT Pub. Date: Mar. 10, 2005

(65) Prior Publication Data

US 2006/0254423 A1 Nov. 16, 2006

(30) Foreign Application Priority Data

Aug. 29, 2003 (JP) ..... 2003-306775
Mar. 15, 2004 (JP) ..... 2004-072193

(51) Int. Cl.
*B03C 3/40* (2006.01)

(52) U.S. Cl. ..... 96/66; 95/58; 96/83; 96/84; 96/95; 96/100; 422/186.04

(58) Field of Classification Search ..... 96/95–100, 96/65, 66, 83, 84; 95/58; 422/186.04
See application file for complete search history.

(56) References Cited

U.S. PATENT DOCUMENTS 4,666,474 A * 5/1987 Cook ..... 96/90
4,822,381 A * 4/1989 Mosley et al. ..... 95/79
5,037,456 A * 8/1991 Yu ..... 96/76
5,290,343 A * 3/1994 Morita et al. ..... 96/39
5,322,550 A * 6/1994 Park ..... 96/66
5,433,772 A * 7/1995 Sikora ..... 96/87
6,092,387 A * 7/2000 Hironaka et al. ..... 62/317
6,163,098 A * 12/2000 Taylor et al. ..... 310/308
6,524,369 B1 * 2/2003 Krigmont ..... 95/78
6,579,349 B1 * 6/2003 Ting et al. ..... 96/44

(Continued)

FOREIGN PATENT DOCUMENTS

JP 4-293563 A * 10/1992 ..... 96/97

(Continued)

*Primary Examiner*—Richard L. Chiesa
(74) *Attorney, Agent, or Firm*—Global IP Counselors

(57) ABSTRACT

A gas treating device capable of electrically collecting dust and of decomposing odors and other matter by plasma includes a plasma generating device integrally incorporated into an ionization part in a casing. The ionization part has an ionization line and a columnar portion of a negative electrode member. The plasma generating device includes a discharge electrode which shares a counter electrode with the ionization line. During operation, dust of a relatively small size in room air is electrically charged by discharge between the ionization line and the counter electrode. An electrostatic filter entraps and collects the electrically charged dust. A plasma of low temperature is generated by streamer discharge between the discharge electrode and the counter electrode. Harmful substances and odorous substances in the room air are decomposed by an activated species contained in the generated low-temperature plasma.

9 Claims, 6 Drawing Sheets

U.S. PATENT DOCUMENTS

| | | | | |
|---|---|---|---|---|
| 6,679,940 | B1 * | 1/2004 | Oda | 96/55 |
| 2004/0065202 | A1 * | 4/2004 | Gatchell et al. | 96/66 |

FOREIGN PATENT DOCUMENTS

| | | | |
|---|---|---|---|
| JP | 05-007798 | | 1/1993 |
| JP | 10-263434 | | 10/1998 |
| JP | 11-019534 | | 1/1999 |
| JP | 2001-129430 | | 5/2001 |
| JP | 2001-218828 | | 8/2001 |
| JP | 2002-143634 | | 5/2002 |
| WO | WO 01/19419 | A1 * | 3/2001 |

* cited by examiner

GAS TREATING DEVICE

CROSS-REFERENCE TO RELATED APPLICATIONS

This U.S. National stage application claims priority under 35 U.S.C. §119(a) to Japanese Patent Application Nos. 2003-306775, filed in Japan on Aug. 29, 2003, and 2004-072193, filed in Japan on Mar. 15, 2004, the entire contents of which are hereby incorporated herein by reference.

TECHNICAL FIELD

The present invention relates to gas treating devices for the removal of dust, odors, and other matter in the air by causing discharge to take place.

BACKGROUND ART

As one type of conventionally-known gas treating device, there is an air purifying device for removing airborne dust, odors, and other matter by discharge. One such gas treating device is disclosed in JP, 2001-218828, A. This air purifying device is provided with a dust collecting filter and a plasma generating device. The plasma generating device has a plasma generating electrode plate and a counter electrode plate. And, by application of discharge voltage to both the electrode plates the streamer discharge takes place, wherein a plasma is generated.

In the above-described air purifying device, the dust collecting filter entraps and collects dust in the air. In addition, in the plasma generating device, unpleasant odorous components in the air are decomposed and removed by a substance of high reactivity (such as an activated species) contained in the plasma generated by the streamer discharge. And, the clean air, after removal of such dust and unpleasant odorous components, is released to outside the air purifying device as a stream of supply air.

PROBLEMS THAT THE INVENTION INTENDS TO SOLVE

As described above, in the air purifying device disclosed in the patent gazette, dust is removed by filtration with the aid of the dust collecting filter. On the other hand, as a means for removing airborne dust, a so-called electrical dust collecting technique is known. That is, there is a generally-known dust collecting method in which dust in the air is electrically charged by corona discharge and the electrically charged dust is collected by means of an electrostatic filter as an electrical dust collecting member. By the employment of such an electrical dust collecting method, it becomes possible to remove dust of smaller size in comparison with the case where air is simply filtered by a dust collecting filter. The dust collecting capability of the air purifying device of the patent gazette may possibly be enhanced if it employs that electrical dust collecting technique.

In reality, if gas treating devices making utilization of plasmas for deodorization et cetera employ an electrical dust collection technique, this leads to the problems of increasing the device size. In this regard, the description will be made. For the case where the electrical dust collecting technique is employed, discharge and counter electrodes for corona discharge to cause dust to be electrically charged have to be provided in an air passageway, in addition to the provision of discharge and counter electrodes for streamer discharge to generate a plasma. In other words, it is required that discharge and counter electrodes be arranged in two sets. This requires an extra space for the installation of discharge and counter electrodes for causing dust to be electrically charged, therefore increasing the size of the gas treating device proportionally to that extra space.

With these problems in mind, the present invention was made. Accordingly, an object of the present invention is to accomplish downsizing of a gas treating device which performs a so-called electrical dust collecting operation and decomposes odors and other matter by plasma.

SUMMARY OF THE INVENTION

A first aspect of the present invention is directed to a gas treating device for entrapping and collecting dust present in a gas to be treated, and for decomposing a component to be treated present in the gas to be treated. The gas treating device of the first aspect of the present invention comprises: a counter electrode (36); a first discharge electrode (35) for causing discharge to take place between the first discharge electrode (35) and the counter electrode (36) so that the dust in the gas to be treated is electrically charged; an electrical dust collecting member (33) for entrapping and collecting the electrically charged dust in the gas to be treated; and a second discharge electrode (41) for causing discharge to take place between the second discharge electrode (41) and the counter electrode (36) so that a plasma for decomposing the component to be treated is generated.

A second aspect of the present invention according to the gas treating device of the first aspect of the present invention is characterized in that the electrical dust collecting member (33) is formed by an electrostatic filter.

A third aspect of the present invention according to the gas treating device of the first aspect of the present invention is characterized in that a plasma catalyst is provided which is activated by a plasma generated by discharge between the second discharge electrode (41) and the counter electrode (36) and which promotes the decomposition of the component to be treated. Here, preferably the plasma catalyst has adsorption capability for the component to be treated present in the gas to be treated. More preferably, the plasma catalyst is capable of adsorption/decomposition of activated species such as ozone produced with the generation of the plasma.

A fourth aspect of the present invention according to the gas treating device of the first aspect of the present invention is characterized in that the first discharge electrode (35) is formed into a linear shape extending along the counter electrode (36) and that the second discharge electrode (41) is electrically connected to a position somewhere midway in the first discharge electrode (35), and is disposed such that the distance between the second discharge electrode (41) and the counter electrode (36) is shorter than the distance between the first discharge electrode (35) and the counter electrode (36).

A fifth aspect of the present invention according to the gas treating device of the first aspect of the present invention is characterized in that the counter electrode (36) is shaped like a column having a cross section in the shape of a Japanese katakana character "コ", and that at least the second discharge electrode (41) is disposed inside the counter electrode (36).

A sixth aspect of the present invention according to the gas treating device of the first aspect of the present invention is characterized in that an electrode member (37) which is shaped like a corrugated plate and which constitutes the counter electrode (36) is provided, that the first discharge electrode (35) is disposed on the side of one surface of the electrode member (37) and the second discharge electrode (41) is disposed on the side of the other surface of the electrode member (37), and that the first discharge electrode (35) and the second discharge electrode (41) are disposed, respectively, inside concave portions of the corrugated plate-like electrode member (37).

A seventh aspect of the present invention according to the gas treating device of the first aspect of the present invention is characterized in that a photosemiconductor catalyst is provided which is activated by a plasma generated by discharge between the second discharge electrode (41) and the counter electrode (36) and which promotes the decomposition of the component to be treated.

An eighth aspect of the present invention according to the gas treating device of the seventh aspect of the present invention is characterized in that the photosemiconductor catalyst is supported on the electrical dust collecting member (33).

A ninth aspect of the present invention according to the gas treating device of the third aspect of the present invention is characterized in that the plasma catalyst is disposed downstream of the second discharge electrode (41) and the counter electrode (36), that the electrical dust collecting member (33) supports thereon a photosemiconductor catalyst which is activated by a plasma generated by discharge between the second discharge electrode (41) and the counter electrode (36) and which promotes the decomposition of the component to be treated, and that the electrical dust collecting member (33) is disposed between the second discharge electrode (41) and the counter electrode (36), and the plasma catalyst.

WORKING OPERATION

In the first and second aspects of the present inventions, the counter electrode (36) is shared between the first discharge electrode (35) and the second discharge electrode (41). When voltage is applied between the first discharge electrode (35) and the counter electrode (36), the discharge takes place between these electrodes. Dust in the gas to be treated is electrically charged by such discharge. And, the electrical dust collecting member (electrostatic filter) (33) entraps and collects the electrically charged dust.

On the other hand, when voltage is applied between the second discharge electrode (41) and the counter electrode (36), the discharge takes place between these electrodes, thereby generating a plasma. And, in the gas treating device, the generated plasma is used to decompose harmful substances and odorous substances which are treatment-target components present in the gas to be treated.

As described above, the discharge between the first discharge electrode (35) and the counter electrode (36) and the discharge between the second discharge electrode (41) and the counter electrode (36) are different types, and the dust and treatment-target components in the gas to be treated are removed.

In the third aspect of the present invention, the gas treating device is provided with a plasma catalyst. The plasma catalyst is activated by a plasma generated by discharge taking place between the second discharge electrode (41) and the counter electrode (36). The decomposition of the component to be treated in the gas to be treated is promoted by the activated plasma catalyst.

In the fourth aspect of the present invention, the second discharge electrode (41) is electrically connected to a position somewhere midway in the linearly-formed first discharge electrode (35). In other words, electrical conduction is established between the first discharge electrode (35) and the second discharge electrode (41), and they are equal in electrical potential at the time of voltage application.

In this aspect of the present invention, the distance between the second discharge electrode (41) and the counter electrode (36) is shorter than the distance between the first discharge electrode (35) and the counter electrode (36). As a result of such arrangement, although the first and second discharge electrodes (35, 41) are identical in electrical potential with each other, the electrical field intensity between the second discharge electrode (41) and the counter electrode (36) is greater than the electrical field intensity between the first discharge electrode (35) and the counter electrode (36). Consequently, the discharge taking place between the second discharge electrode (41) and the counter electrode (36) is greater in intensity than that taking place between the first discharge electrode (35) and the counter electrode (36).

In the fifth aspect of the present invention, at least the second discharge electrode (41) is positioned inside the column-like counter electrode (36) having a cross section in the shape of a katakana character "コ". The discharge is caused to take place between the second discharge electrode (41) and the inner side surface of the counter electrode (36). In addition, besides the second discharge electrode (41) the first discharge electrode (35) may be disposed inside the counter electrode (36).

In the sixth aspect of the present invention, the gas treating device is provided with the electrode member (37). The electrode member (37) is shaped like a corrugated plate comprising an alternating pattern of "mountain" portions and "valley" portions. In addition, the waves in the electrode member (37) may be in any shape including sine-wave shape, rectangular wave shape, triangular wave shape et cetera.

The first discharge electrode (35) is disposed on the side of one surface of the electrode member (37) while on the other hand the second discharge electrode (41) is disposed on the side of the other surface of the electrode member (37) opposite to the one surface. The first discharge electrode (35) is positioned in a "valley" portion as viewed from the side of the one surface of the electrode member (37), in other words it is positioned inside a concave portion. On the other hand, the second discharge electrode (41) is positioned in a "valley" portion as viewed from the side of the other surface of the electrode member (37), in other words it is positioned inside a concave portion. And, the discharge takes place between the first discharge electrode (35) and the electrode member (37) and between the second discharge electrode (41) and the electrode member (37), respectively.

In the seventh aspect of the present invention, the gas treating device is provided with a photosemiconductor catalyst. Photosemiconductor catalyst is generally used as a "photocatalyst" which is activated when illuminated with light. The photosemiconductor catalyst of the present invention, however, is activated by a plasma generated by discharge taking place between the second discharge electrode (41) and the counter electrode (36), even when the luminous source is not being illuminated. The decomposition of the component to be treated present in the gas to be treated is promoted by the activated photosemiconductor catalyst.

Here, photosemiconductor catalyst has properties that impede the adhesion of contaminants thereto. Therefore, the deterioration in activation operation of the photosemiconductor catalyst due to the adhesion of dust or other matter in the gas to be treated to the surface of the photosemiconductor catalyst is suppressed.

In the eighth aspect of the present invention, the electrical dust collecting member (33) supports thereon a photosemiconductor catalyst. And, the photosemiconductor catalyst is activated by a plasma generated by discharge taking place between the second discharge electrode (41) and the counter electrode (36). The decomposition of the component to be treated present in the gas to be treated is expedited by the activated photosemiconductor catalyst.

In addition, the component to be treated which is deposited on the electrical dust collecting member (33), for example such as cigarette tar and allergen, can be decomposed by the photosemiconductor catalyst. Furthermore, the photosemiconductor catalyst suppresses the growth of fungus in the electrical dust collecting member (33).

In the ninth aspect of the present invention, the electrical dust collecting member (33) with a photosemiconductor catalyst supported thereon is positioned downstream of the second discharge electrode (41) and the counter electrode (36). Furthermore, positioned downstream of the electrical dust collecting member (33) is a plasma catalyst. As a result of such arrangement, both the photosemiconductor catalyst of the electrical dust collecting member (33) and the plasma catalyst are activated by a plasma generated by discharge taking place between the second discharge electrode (41) and the counter electrode (36). And, the decomposition of the component to be treated present in the gas to be treated is effectively promoted by the activated photosemiconductor catalyst and by the activated plasma catalyst.

Here, if the photosemiconductor catalyst and the plasma catalyst have different activation properties, this makes it possible to effectively decompose the component to be treated which contains therein a combined odorous component.

In addition, if the plasma catalyst has adsorption capability for the component to be treated present in the gas to be treated, this makes it possible for the plasma catalyst to adsorb and remove the component to be treated which has not been decomposed by activation of the photosemiconductor catalyst and the plasma catalyst.

Furthermore, if the plasma catalyst has the capability to adsorb and decompose activated species such as ozone which is generated during plasma discharge, this makes it possible for the plasma catalyst to adsorb, decompose, and eliminate activated species such as ozone.

EFFECTS

In the present invention, the counter electrode (36) is shared between the first discharge electrode (35) and the second discharge electrode (41), and dust and components to be treated, present in a treatment-target gas, are removed. In other words, the first and second discharge electrodes (35, 41) do not cause discharge against their respective counter electrodes, but they do so against their common counter electrode (36). Therefore, in accordance with the present invention, by sharing the counter electrode (36) between the first discharge electrode (35) and the second discharge electrode (41), the space required to install them can be reduced, thereby making it possible to downsize the gas treating device.

In accordance with the third aspect of the present invention, the component to be treated present in the treatment-target gas is decomposed by a plasma generated as a result of discharge between the second discharge electrode (41) and the counter electrode (36), and its decomposition is expedited by the plasma catalyst. Accordingly, the present invention is able to enhance the processing capability of the gas treating device.

In the fourth aspect of the present invention, the second discharge electrode (41) is electrically connected to a position somewhere midway in the first discharge electrode (35), thereby eliminating the need for individual voltage application to both the first and second discharge electrodes (35, 41). This makes is possible to apply voltage to both the first and second electrodes (35, 41), for example, by just connecting the first discharge electrode (35) to the power supply source. Therefore, the present invention provides a simplified voltage-application configuration.

In the sixth aspect of the present invention, the first discharge electrode (35) is positioned inside a concave portion on the side of one surface of the electrode member (37) shaped like a corrugated plate while on the other hand the second discharge electrode (41) is positioned inside a concave portion on the side of the other surface of the electrode member (37). Such arrangement allows both the first and second discharge electrodes (35, 41) to be stowed in place within the thickness of the corrugated plate-like electrode member (37). Therefore, in accordance with the present invention, the installation of the first and second discharge electrodes (35, 41) requires less space, thereby making it possible to further downsize the gas treating device.

In accordance with the seventh aspect of the present invention, the decomposition of the component to be treated by plasma discharge is promoted by activation of the photosemiconductor catalyst, thereby making it possible to enhance the processing capability of the gas treating device.

In addition, the photosemiconductor catalyst has properties that impede the adhesion of contaminants thereto. Therefore, the deterioration in activation operation of the photosemiconductor catalyst due to the adhesion of contaminants present in the gas to be treated to the surface of the photosemiconductor catalyst is suppressed. Therefore, it is possible to stabilize the processing capability of the gas treating device.

In accordance with the eighth aspect of the present invention, the electrical dust collecting member (33) supports thereon a photosemiconductor catalyst, so that the activation operation of the photosemiconductor catalyst can be given to the electrical dust collecting member (33). Therefore, the effect of entrapping and collecting dust by the electrical dust collecting member (33) and the effect of promoting decomposition by the photosemiconductor catalyst can be obtained by a compact configuration.

In addition, the arrangement that the electrical dust collecting member (33) supports thereon a photosemiconductor catalyst provides the effect of decomposition of odorous components adsorbed on the electrical dust collecting member (33) or the effect of bacteria elimination in the electrical dust collecting member (33). Accordingly, the operational life span of the electrical dust collecting member (33) is extended.

In accordance with the ninth aspect of the present invention, the electrical dust collecting member (33) supporting thereon a photosemiconductor catalyst and the plasma catalyst are disposed downstream of the second discharge electrode (41) and the counter electrode (36), and by activating both the photosemiconductor catalyst and the plasma catalyst the action of decomposing the component to be treated is promoted. Accordingly, the processing capability of the gas treating device is enhanced effectively.

Here, if the photosemiconductor catalyst and the plasma catalyst have different activation properties, this makes it possible to effectively decompose the component to be treated which contains therein a combined odorous component. Accordingly, the gas treating device's capability to treat the gas to be treated which contains a combined odorous component can be enhanced.

In addition, if the plasma catalyst has adsorption capability for the component to be treated, this makes it possible for the plasma catalyst to adsorb and remove the component to be treated which has still remained undecomposed/unremoved after treatment by plasma discharge. Accordingly, it is possible to obtain processing capability following the variation in density load of the odorous component, thereby making it possible to enhance the reliability of the gas treating device.

Furthermore, if the plasma catalyst has the capability to adsorb and decompose activated species such as ozone generated as a result of plasma discharge, this makes it possible for the plasma catalyst to decompose and eliminate activated species such as ozone. This prevents activated species (by-product matters) generated in the device by plasma discharge from being emitted to outside the device, thereby making it possible to further improve the reliability of the gas treating device.

DETAILED DESCRIPTION OF THE INVENTION

Hereinafter, embodiments of the present invention are described in detail with reference to the drawings. Each embodiment relates to a gas treating device which is an air purifying device (10) for general household use or for use in small-scale stores.

First Embodiment of the Invention

Figure 1:
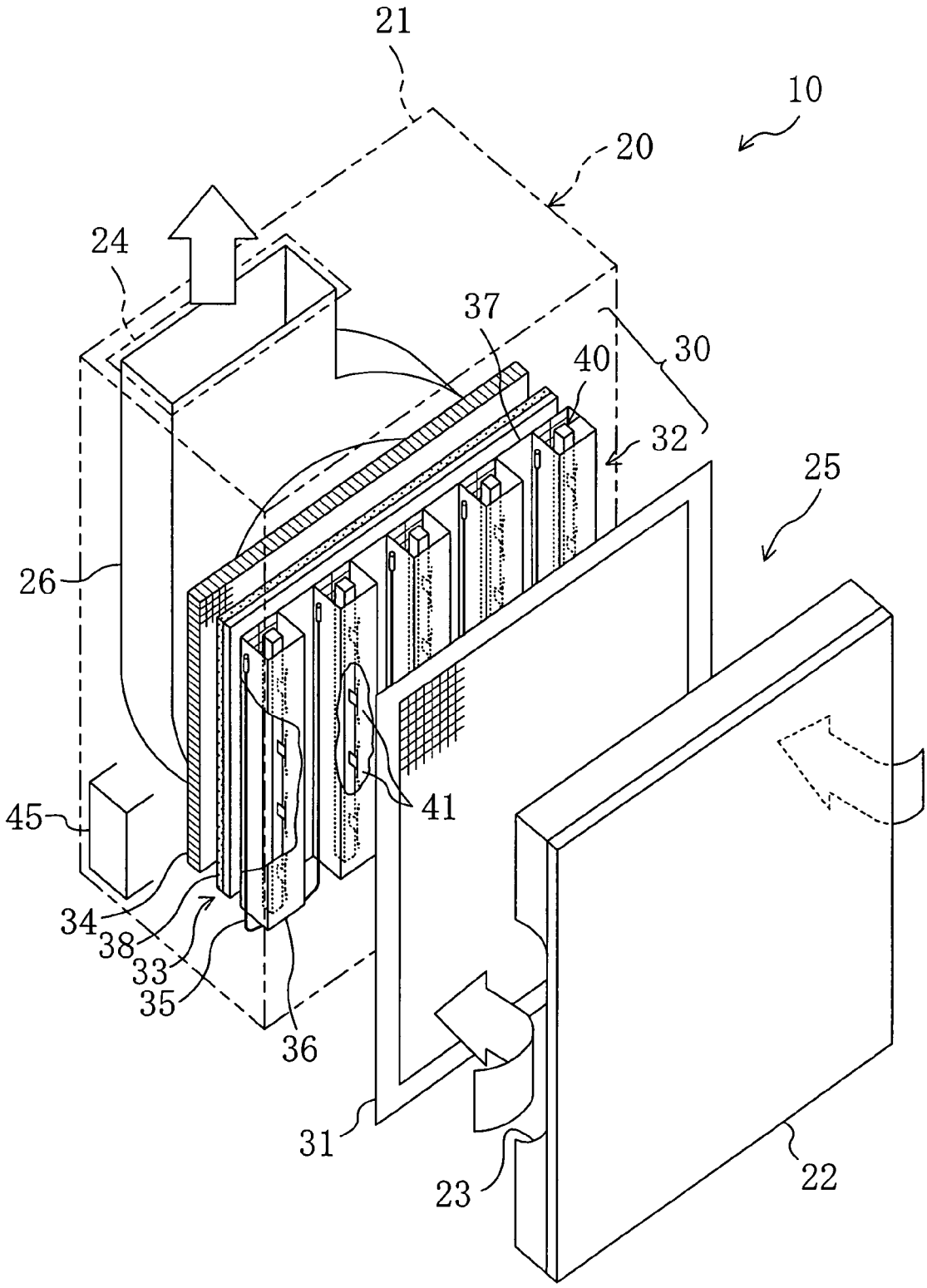
FIG. 1 is an exploded perspective view of an air purifying device according to a first embodiment of the present invention.

As shown in FIG. 1, the air purifying device (10) of the present embodiment has a casing (20) made up of a box-like casing main body (21) one end of which is opened and a front plate (22) which is mounted to the open end. Formed in both side surfaces of the casing (20) on the front plate's (22) side are air suction openings (23). In addition, the casing main body (21) has an air blowout opening (24) which is formed in an area of the top plate close to the back plate.

Formed within the casing (20) is an air passageway (25) through which room air as a gas to be treated flows from the air suction openings (23) to the air blowout opening (24). Arranged, in sequence from the upstream side of the flow of air, along the air passageway (25) are a functional section (30) including various components for air cleaning, and a centrifugal air blower (26) for distribution of room air through the air passageway (25).

Disposed, in sequence from the front plate's (22) side, in the functional section (30) are a pre-filter (31), an ionization part (32), an electrostatic filter (33) as an electrical dust collecting member, and a catalytic filter (34). A plasma generating device (40) for generating a plasma of low temperature is integrally incorporated into the ionization part (32).

The pre-filter (31) is disposed to entrap and collect dust of relatively large size present in the room air.

The ionization part (32) causes dust of relatively small size present in the room air passing through the pre-filter (31) to be electrically charged. The electrically charged dust is entrapped and collected by the electrostatic filter (33) positioned downstream of the ionization part (32).

The ionization part (32) is provided with a negative electrode member (37) as an electrode member. The negative electrode member (37) is a metal plate which is shaped like a corrugated plate by press forming, and is disposed in an upright position within the casing (20). More specifically, the negative electrode member (37) is shaped like a corrugated plate whose wave shape is rectangular. In other words, in the negative electrode member (37), columnar portions having a cross section in the shape of a katakana character "コ" and extending vertically, and rectangular plate-like portions which are vertically elongated are alternately formed in horizontal direction. And, the negative electrode member (37) is oriented, such that the open side of each of the cross-sectionally "コ"-shaped columnar portions faces towards the electrostatic filter (33), in other words the open side faces downstream of the airflow therethrough.

Figure 2:
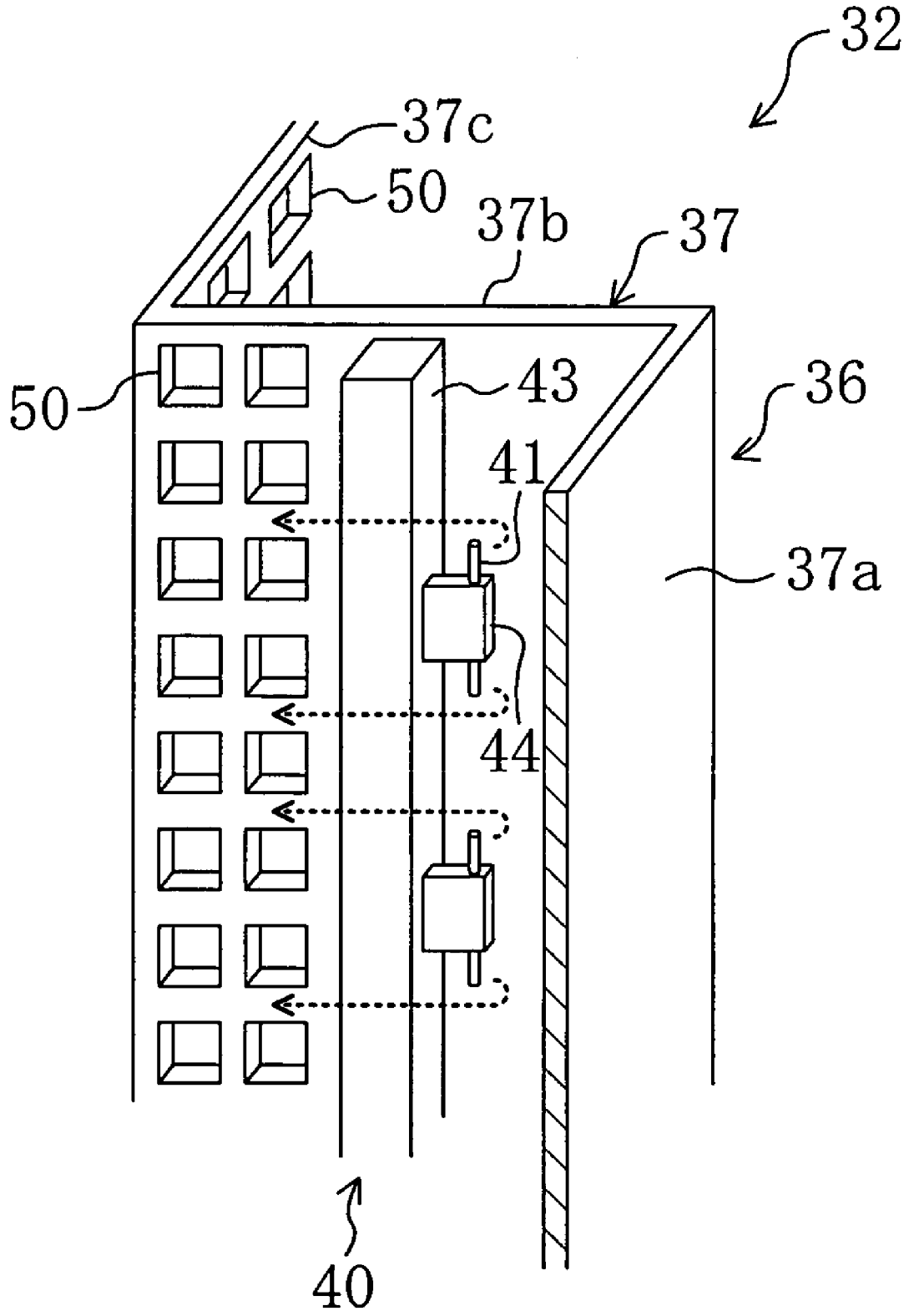
FIG. 2 is a perspective view illustrating in enlarged manner a major section of an ionization part in the air purifying device of the first embodiment.

In the negative electrode member (37), each cross-sectionally "コ"-shaped columnar portion constitutes a respective counter electrode (36). In the columnar portion, portions orthogonal to the opening side of the columnar portion constitute a pair of side surface portions (37*b*), and a portion orthogonal to the side surface portions (37*b*) and situated on the side of the pre-filter (31) constitutes a front surface portion (37*a*). On the other hand, in the negative electrode member (37), a rectangular portion sandwiched between adjoining columnar portions constitutes a back surface portion (37*c*). With reference to FIG. 2, a large number of air apertures (50) are opened at the back surface portion (37*c*). Likewise, a large number of air apertures (50) are opened in a specific area of the side surface portion (37*b*) near the back surface portion (37*c*).

An ionization line (35) serving as a first discharge electrode is provided in a plural number in the ionization part (32). The ionization line (35) is arranged inside a concave portion when viewing the negative electrode member (37) from the pre-filter's (31) side, in other words the ionization line (35) is arranged interior to a portion enclosed on three sides by a pair of side surface portions (37*b*) and a back surface portion (37*c*). In addition, the ionization line (35) extends across the ionization part (32) from the top end to the bottom end. At its lower end, the ionization line (35) strides across the counter electrode (36). Each ionization line (35) is located on a single virtual surface in parallel with the electrostatic filter (33), being evenly spaced apart from the other.

The plasma generating device (40) is provided with a discharge electrode (41) serving as a second discharge electrode, and shares the counter electrode (36) with the ionization line (35).

As shown in FIG. 2, the discharge electrode (41) is arranged inside a concave portion when viewing the negative electrode member (37) from the electrostatic filter's (33) side, in other words the discharge electrode (41) is arranged interior to a portion enclosed on three sides by a front surface portion (37*a*) and a pair of side surface portions (37*b*). In other words, the discharge electrode (41) is disposed inside the cross-sectionally "ㄱ"-shaped counter electrode (36). More specifically, a columnar electrode holding member (43) having a square cross section and extending vertically is disposed inside the counter electrode (36). Of the side surfaces of the electrode holding member (43), a side surface on the front surface portion's (37*a*) side is provided with a plurality of securing members (44) which are vertically evenly spaced apart from each other. Each securing member (44) is provided with a respective discharge electrode (41). That is to say, the discharge electrode (41) is secured to the electrode holding member (43) by the securing member (44). The discharge electrode (41) is an electrode in the form of a line or rod. The discharge electrode (41) is arranged such that its portion projecting from the securing member (44) runs substantially parallel with the front surface portion (37*a*).

Additionally, the electrode holding member (43) and the securing member (44) are formed of the same type of metal as the discharge electrode (41). The discharge electrode (41) and the electrode holding member (43) electrically conduct with each other through the securing member (44).

The ionization part (32) is provided with a high-voltage direct-current power source (45) for applying voltage between the ionization line (35) and the counter electrode (36). The DC power source (45) serves also as a power source for the plasma generating device (40). Upon the application of a voltage to the ionization line (35) and to the discharge electrode (41) by the DC power source (45), ions are generated around the ionization line (35) and streamer discharges are generated from the leading end of the discharge electrode (41) towards the counter electrode (36). Although the ionization line (35) and the discharge electrode (41) are fed a high voltage of the same potential (for example, 5 kV), the action of generating ions in the ionization part (32) is designed to take place simultaneously with the action of causing streamer discharge to take place in the plasma generating device (40) by making a difference in electric field intensity by setting the distance between the ionization line (35) and the counter electrode (36) and the distance between the discharge electrode (41) and the counter electrode (36), for example, at 10 mm and at 5 mm, respectively.

The electrostatic filter (33) is disposed downstream of the plasma generating device (40) made up of the discharge electrode (41) and the counter electrode (36). The electrostatic filter (33) entraps and collects, at its upstream side surface, dust of relatively small size electrically charged by the ionization part (32). The downstream side surface of the electrostatic filter (33) supports thereon a photosemiconductor catalyst to form a photosemiconductor catalyst layer (38). The photosemiconductor catalyst of the photosemiconductor catalyst layer (38) further activates substances (activated species such as electron, ion, ozone, radical etc.) of high reactivity present in the low-temperature plasma generated by discharge between the discharge electrode (41) and the counter electrode (36), and promotes the decomposition of harmful substances and odorous substances which are components to be treated present in room air. As the photosemiconductor catalyst, for example titanium dioxide and zinc oxide, or oxides of tungsten and cadmium sulfide may be used.

The catalytic filter (34) is disposed downstream of the electrostatic filter (33). The catalytic filter (34) is formed, for example, by a honeycomb-structure substrate which supports on its surface a plasma catalyst. This plasma catalyst, like the aforesaid photosemiconductor catalyst, further activates substances (activated species such as electron, ion, ozone, radical etc.) of high reactivity present in the low-temperature plasma generated as a result of discharge between the discharge electrode (41) and the counter electrode (36), and promotes the decomposition of harmful substances and odorous substances which are components to be treated in the room air. As the plasma catalyst, for example a catalyst of the manganese family, a catalyst of the precious metal family, or a catalyst formed by addition of an adsorbent, e.g., activated carbon, to such catalysts may be used.

Running Operation

Next, the running operation of the air purifying device (10) is described.

When the air purifying device (10) is in operation, the centrifugal air blower (26) is started, and room air which is a gas to be treated flows and passes through the air passageway (25) within the casing (20). In addition, in this state, high voltage is applied, by the DC power source (45), to the ionization part (32) and to the plasma generating device (40).

When a stream of room air is introduced into the casing (20), dust of relatively large size is removed by the pre-filter (31). After passage through the pre-filter (31), the room air flows to the ionization part (32). In the ionization part (32), dust of relatively small size present in the room air is electrically charged by discharge between the ionization line (35) and the counter electrode (36). The room air containing the electrically charged dust passes through the air apertures (50) provided in the side and back surface portions (37*b*, 37*c*) and then flows into the electrostatic filter (33). The electrostatic filter (33) entraps and collects the electrically charged dust.

In the plasma generating device (40) integrally incorporated into the ionization part (32), a low-temperature plasma is being generated by streamer discharge between the discharge electrode (41) and the counter electrode (36). On the other hand, during discharge, an ion wind is generated. The ion wind is reflected from the front surface portion (37*a*), flowing downstream of the airflow, as indicated by broken line of FIG. 2. And, the generated low-pressure plasma rides on the ion wind, passes through the ionization part (32), and flows downstream together with the room air.

The low-temperature plasma contains therein a substance (activated species) of high reactivity. And, when coming into contact with room air flowing through the air passageway (25), the high-reactivity substance decomposes harmful substances and odorous substances present in the room air. In addition, when the activated species reaches the electrostatic filter (33), it is activated to a further extent by the photosemiconductor catalyst supported on the photosemiconductor catalyst layer (38) of the electrostatic filter (33), as a result of which the harmful and odorous substances in the room air are decomposed to a further extent. And, when the activated species reaches the catalytic filter (34), it is further activated, as a result of which the harmful and odorous substances in the room air are decomposed to a still father extent.

The room air, purified by removal of dust, harmful substances, and odorous substances, is taken into the centrifugal air blower (26) and is blown out into the room through the air blowout opening (24).

Effects of First Embodiment

In the present embodiment, the counter electrode (36) is shared between the ionization part (32) and the plasma generating device (40). In other words, the ionization line (35) and the discharge electrode (41) do not discharge, respectively, to individual counter electrodes but to their common counter electrode (36). Therefore, in accordance with the present embodiment, the counter electrode (36) is common to the ionization line (35) and the discharge electrode (41), thereby making it possible to reduce their installation space. Therefore, it is possible to downsize the air purifying device (10).

In accordance with the present embodiment, harmful substances and odorous substances present in room air are decomposed by a plasma generated by discharge between the discharge electrode (41) and the counter electrode (36) and, in addition, the plasma catalyst expedites the decomposition of harmful substances and odorous substances present in room air. Therefore, in accordance with the present embodiment, it is possible to enhance the processing capability of the air purifying device (10).

In addition, in the present embodiment, the discharge electrode (41) is arranged interior to the cross-sectionally "⌐"-shaped counter electrode (36). As a result of such arrangement, an ion wind generated by discharge is not diffused outwardly of the counter electrode (36) but flows downstream of the airflow. This allows the plasma, generated by discharge between the discharge electrode (41) and the counter electrode (36), to be supplied, together with the ion wind, to the catalytic filter (34) without fail. Therefore, in accordance with the present embodiment, the decomposition of harmful substances and odorous substances present in room air is promoted to a further extent, thereby making it possible to further enhance the processing capability of the air purifying device (10).

Additionally, in accordance with the present embodiment, because of the arrangement that the discharge electrode (41) is positioned downstream of the counter electrode (36), the amount of dust or other matter in room air adhering to the discharge electrode (41) can be reduced considerably. Therefore, it becomes possible to cause stable streamer discharge to continuously take place between the discharge electrode (41) and the counter electrode (36), thereby making it possible to continuously maintain the processing capability of the air purifying device (10).

Furthermore, in the present embodiment, the ionization line (35) is arranged inside a concave portion on the side of one surface of the negative electrode member (37) shaped like a corrugated plate while on the other hand the discharge electrode (41) is arranged inside a concave portion on the side of the other surface of the negative electrode member (37). Because of such arrangement, both the ionization line (35) and the discharge electrode (41) can be stowed in place within the range of the thickness of the corrugated plate-like negative electrode member (37). Therefore, in accordance with the present embodiment, the installation space of the ionization line (35) and the discharge electrode (41) is further reduced, thereby making it possible to downsize the air purifying device (10) to a further extent.

In addition, in accordance with the present embodiment, the electrostatic filter (33) supports thereon a photosemiconductor catalyst, thereby making it possible to promote the decomposition of harmful substances and odorous substances in the room air with the aid of plasma. This therefore enhances the processing capability of the air purifying device (10). In addition, the electrostatic filter (33) integrally incorporates thereinto a photosemiconductor catalyst, thereby making it possible to reduce the thickness of the air purifying device (10), and the size of the air purifying device (10) is reduced accordingly.

Furthermore, the arrangement that the electrostatic filter (33) supports thereon a photosemiconductor catalyst provides the effect of decomposition of odorous components adsorbed on the electrostatic filter (33) or the effect of bacteria elimination in the electrostatic filter (33). Accordingly, the operational life span of the electrostatic filter (33) is extended.

Variations of First Embodiment

With respect to the air purifying device (10) of the first embodiment, the change in configuration of the plasma generating device (40) in the ionization part (32) may be made.

Figure 3:
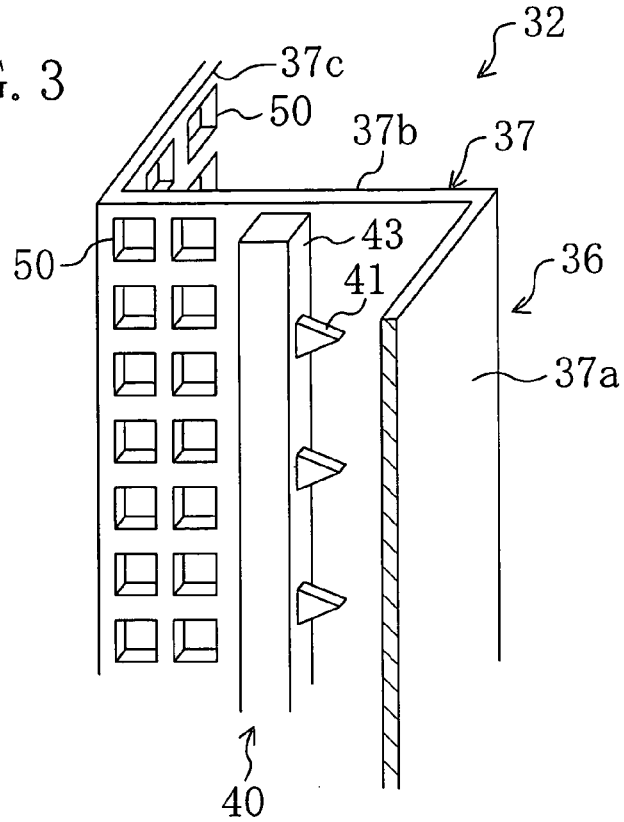
FIG. 3 is a perspective view illustrating in enlarged manner a major section of an ionization part in the air purifying device of the first embodiment.

In a first variation of the first embodiment (FIG. 3), the discharge electrode (41) is attached to the electrode holding member (43) of the plasma generating device (40).

The discharge electrode (41) is a small piece shaped like a triangular plate and is provided such that it stands on a side surface of the electrode holding member (43) on the front surface portion's (37*a*) side. And, upon application of voltage, streamer discharges are generated towards the counter electrode (36) from the leading end of the discharge electrode (41).

Figure 4:
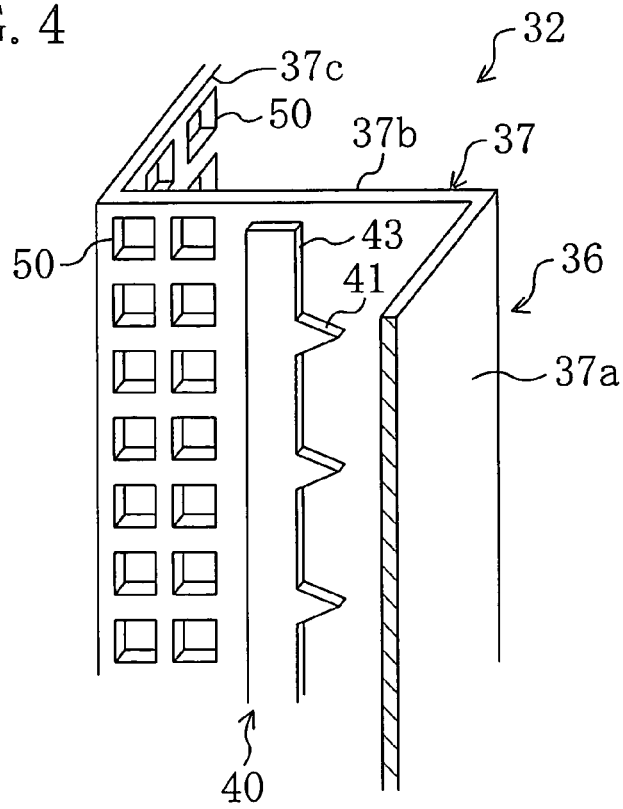
FIG. 4 is a perspective view illustrating in enlarged manner a major section of an ionization part in the air purifying device of the first embodiment.

In a second variation of the first embodiment (FIG. 4), the electrode holding member (43) of the plasma generating device (40) comprises a portion which serves as the discharge electrode (41). In other words, the discharge electrode (41) is retained not by the electrode holding member (43), and portions of the electrode holding member (43) serve as discharge electrodes (41) which are projections evenly spaced apart from each other.

More specifically, the electrode holding member (43) is shaped like a vertically long, elongated flat plate, being arranged in parallel with the side surface portion (37*b*).

A side surface of the electrode holding member (43) situated on the front surface portion's (37*a*) side is provided with a plurality of triangular projections uniformly spaced apart from each other. Each projection serves as a respective discharge electrode (41). And, upon application of voltage, streamer discharges are generated towards the counter electrode (36) from the leading end of the discharge electrode (41).

Second Embodiment of the Invention

A second embodiment of the present invention is similar to the first embodiment, with the exception of modifications in the configuration of the ionization part (32). The difference between the first embodiment and the present embodiment is described below.

Figure 5:
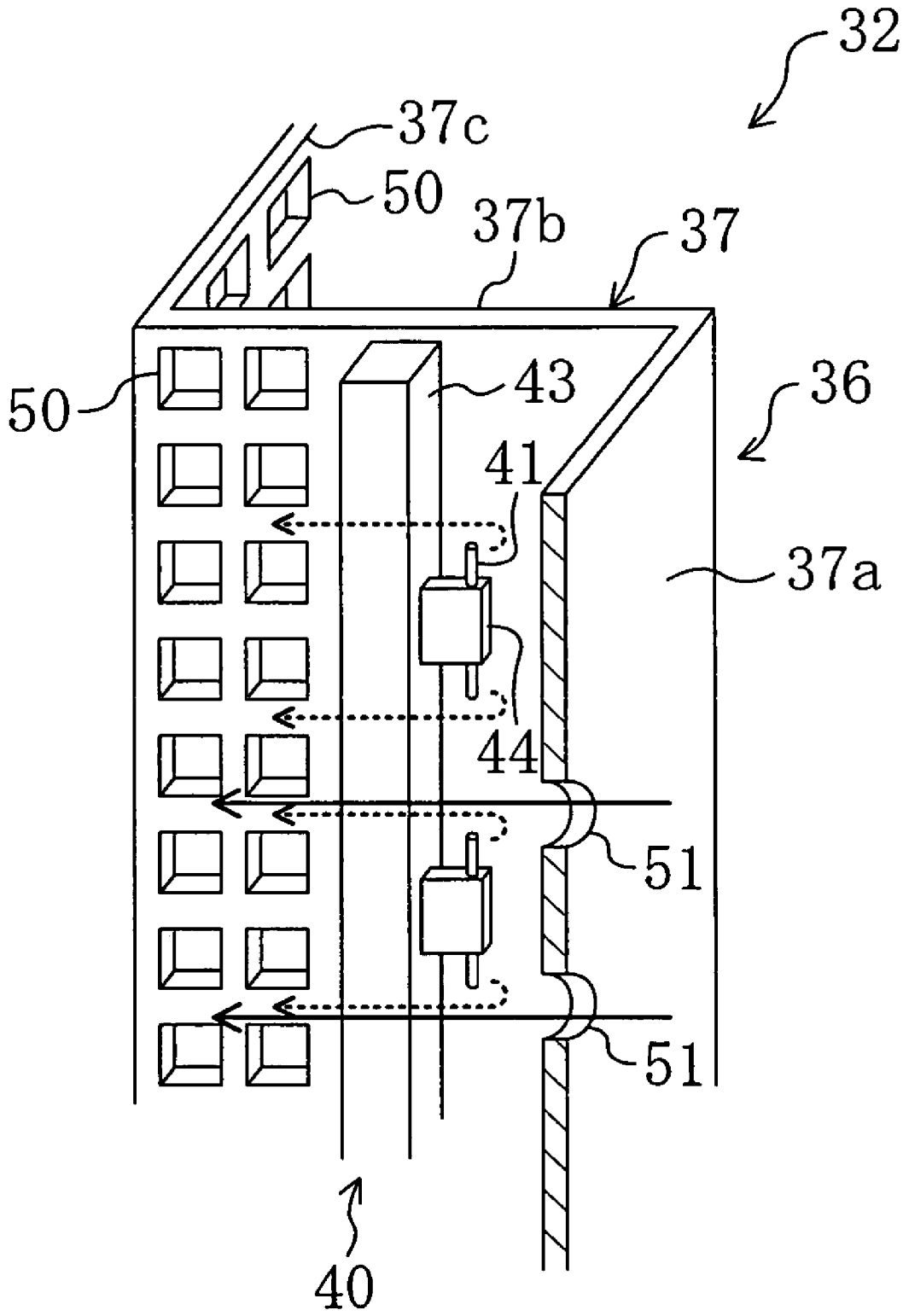
FIG. 5 is a perspective view illustrating in enlarged manner a major section of an ionization part in an air purifying device of a second embodiment of the present invention.

With reference to FIG. 5, in the air purifying device (10) of the present embodiment, the front surface portion (37*a*) of the ionization part (32) is provided with a plurality of circular vent holes (51). Each vent hole (51) is formed, such that its opening lies at the approximately same level as that of the intermediate point between adjoining securing members (44) mounted on the electrode holding member (43). A part of the room air after passage through the pre-filter (31) flows, through the vent holes (51), into the ionization part (32), as indicated by solid line of FIG. 5.

Meanwhile, in the plasma generating device (40), a plasma of low temperature is being generated by streamer discharge between the discharge electrode (41) and the counter electrode (36). The activated species contained in the low-temperature plasma rides on a flow of room air after passage through the vent holes (51) and flows towards the catalytic filter (34) while being diffused all over the air passageway (25). In the catalytic filter (34), its plasma catalyst is activated further, thereby further promoting the decomposition of harmful substances and odorous substances present in the room air. Therefore, the present embodiment ensures that harmful substances and odorous substances present in room air flowing through the air passageway (25) are decomposed, thereby making it possible to enhance the processing capability of the air purifying device (10).

Third Embodiment of the Invention

Figure 6:
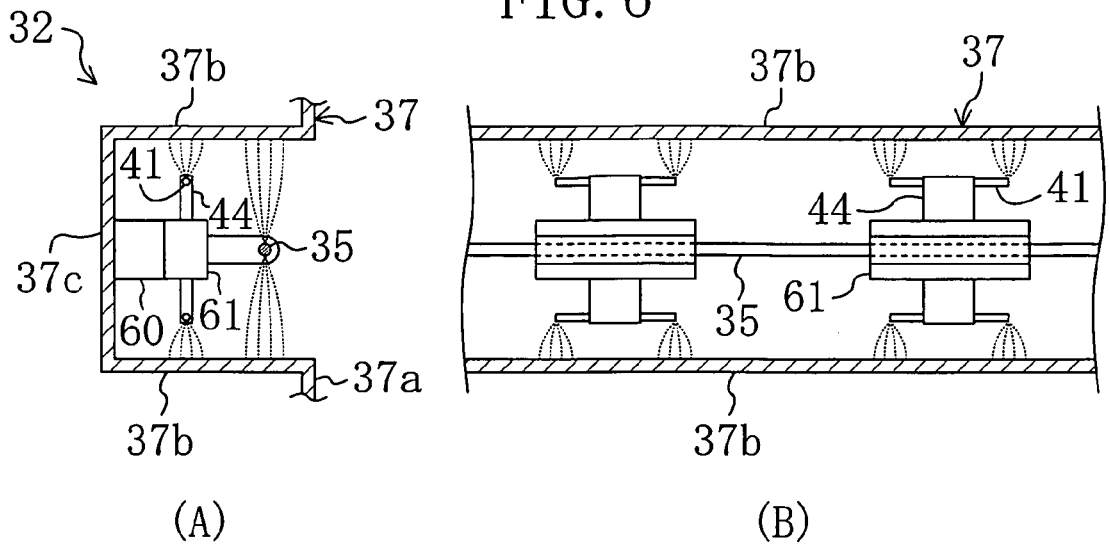
FIG. 6 is a schematic view showing the arrangement of an ionization part in an air purifying device of a third embodiment of the present invention.

A third embodiment of the present invention is similar to the first embodiment, with the exception of modifications in the configuration of the ionization part (32). With reference to FIG. 6, the difference between the first embodiment and the present embodiment is described below. FIG. 6(A) is a top plan view. FIG. 6(B) is an illustration as viewed from upstream of the airflow. FIG. 7(A) is a top plan view. FIG. 7(B) is an illustration as viewed from upstream of the airflow.

In the air purifying device (10) of the present embodiment, the back surface portion (37*c*) of the ionization part (32) is provided with a plurality of insulators (60) for insulation. The insulators (60) are used to insulate electrical continuity and are evenly spaced apart from each other in the vertical direction of the negative electrode member (37). Attached to a side surface of each insulator (60) on the pre-filter's (31) side is a conducting member (61). The conducting member (61) conducts electricity.

The discharge electrode (41) is attached, through the securing member (44), to the side surfaces of the conducting member (61) that is situated on the side surface portion (37*b*). In addition, the ionization line (35) is arranged on a side surface of the conducting member (61) on the pre-filter's (31) side. The ionization line (35) is supported on the conducting member (61). In other words, the ionization line (35) and the discharge electrode (41) electrically conduct with each other through the conducting member (61).

Upon the application of a discharge voltage to either one of the ionization line (35) and the discharge electrode (41), the ionization line (35) and the discharge electrode (41) become identical in potential with each other. And, the discharge takes place between the ionization line (35) and the counter electrode (36) of the side surface portion (37*b*) and between the discharge electrode (41) and the counter electrode (36) of the side surface portion (37*b*).

Here, the distance between the discharge electrode (41) and the counter electrode (36) is sufficiently shorter than the distance between the ionization line (35) and the counter electrode (36), thereby producing a difference in electric field intensity between them. Consequently, the streamer discharge takes place between the discharge electrode (41) and the counter electrode (36) and, as a result, a plasma is generated, whereby harmful substances and odorous substances present in the room air are decomposed and removed. In addition, dust present in the room air is electrically charged by discharge taking place between the ionization line (35) and the counter electrode (36).

Variation of the Third Embodiment

In the air purifying device (10) of the third embodiment, the ionization part (32) may be changed in configuration. The difference between the third embodiment and the present variation is descried below.

Figure 7:
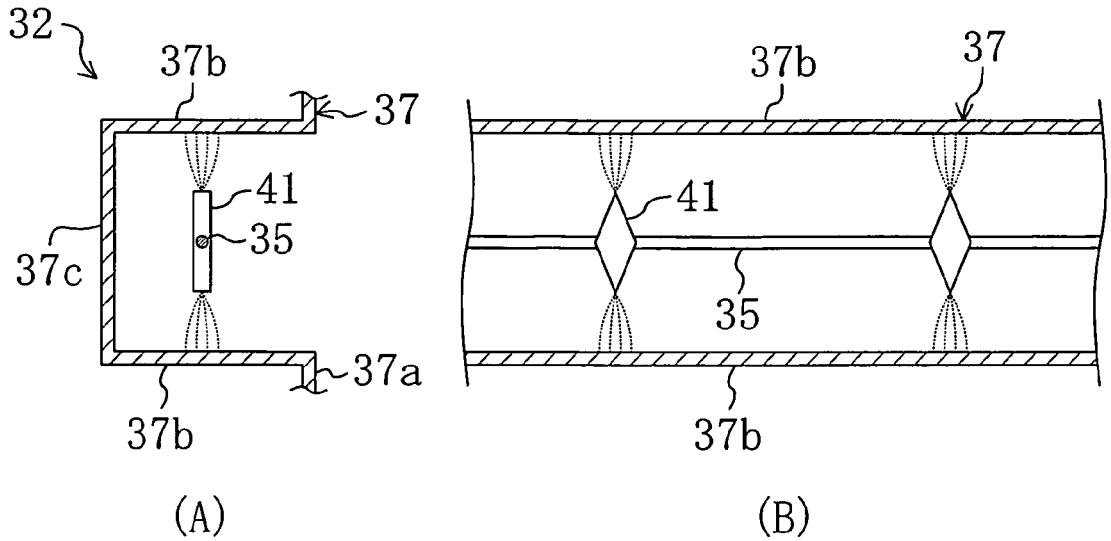
FIG. 7 is a schematic view showing the arrangement of an ionization part in an air purifying device of the third embodiment.

As shown in FIG. 7, in the air purifying device (10) of the present variation, a plurality of discharge electrodes (41) are disposed at respective positions somewhere midway in the ionization line (35), such that they are evenly separated apart from each other. That is to say, the ionization line (35) and each discharge electrode (41) electrically conduct with each other. The discharge electrode (41) has a cross section in the shape of a rhombus as viewed from upstream of the airflow, and is arranged to be symmetrical about the center of the ionization line (35). And, the discharge takes place between the ionization line (35) and the counter electrode (36) of the side surface portion (37*b*) and between the discharge electrode (41) and the counter electrode (36) of the side surface portion (37*b*).

In the present variation, the discharge electrode (41) is electrically connected to a position somewhere midway in the ionization line (35), thereby eliminating the need for individual voltage application to the ionization line (35) and to the discharge electrode (41). As a result of such arrangement, it becomes possible to apply voltage to both the ionization line (35) and the discharge electrode (41), for example, by just connecting the ionization line (35) to the power supply source. Therefore, the present variation provides a simplified voltage application configuration.

OTHER EMBODIMENTS

First Variation

In the air purifying device (10) of the first or second embodiment, the ionization part (32) may be changed in configuration.

Figure 8:
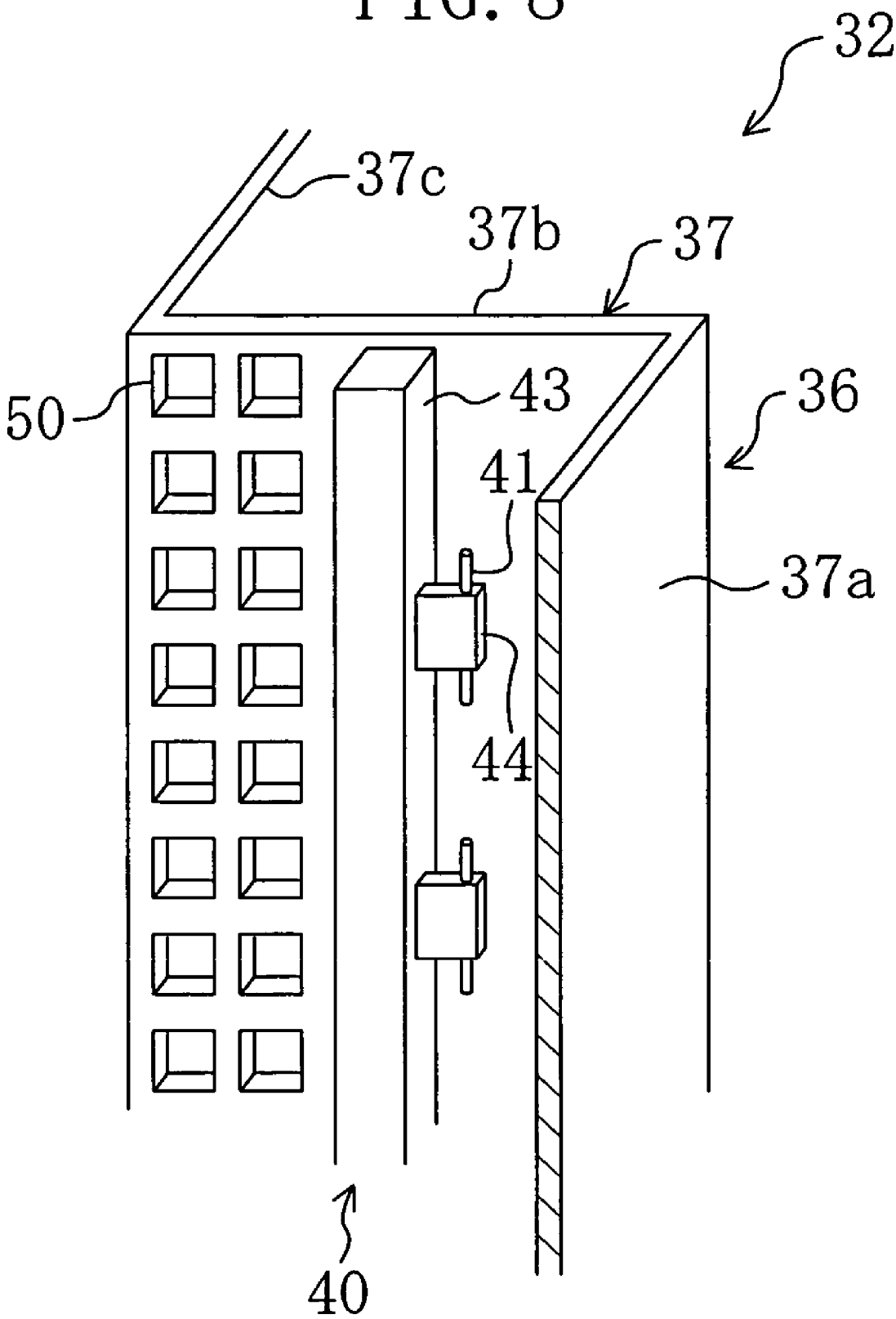
FIG. 8 is a perspective view illustrating in enlarged manner a major section of an ionization part in an air purifying device of another embodiment of the present invention.

As shown in FIG. 8, in the air purifying device (10) of the present variation, the air apertures (50) are formed only in the side surface portion (37*b*) of the negative electrode member (37) of the ionization part (32). Stated another way, the back surface portion (37*c*) has no air apertures (50). All the inflow of room air into the ionization part (32) passes through the air apertures (50) of the side surface portion (37*b*) and then flows downstream from the opening side of the counter electrode (36) arranged in the shape of the katakana character "ㄴ".

On the other hand, in the plasma generating device (40), a plasma of low temperature is being generated by streamer discharge taking place between the discharge electrode (41) and the counter electrode (36). An activated species contained in the low-temperature plasma rides on a flow of room air after passage through the vent holes (51) and flows towards the catalytic filter (34) while being diffused all over the air passageway (25). In the catalytic filter (34), the plasma catalyst is further activated, thereby further promoting the decomposition of harmful substances and odorous substances present in the room air. Therefore, the present variation ensures that harmful substances and odorous substances present in the room air flowing through the air passageway (25) are decomposed, thereby making it possible to enhance the processing capability of the air purifying device (10).

In addition, in the present variation, it may be arranged such that the portion constituting the back surface portion (37*c*), and the portion constituting the front and side surface portions (37*a*, 37*b*) are formed of different members, and that these members are disposed, such that there is a gap therebetween. In this case, the member constituting the back surface portion (37*c*) operates as a baffle plate, and the inflow of room air into the ionization part (32) passes through the gap defined between the member constituting the front and side surface portions (37*a*, 37*b*) and the member constituting the back surface portion (37*c*) and flows downstream.

Second Variation

In the air purifying device (10) of each of the first to third embodiments, the ionization part (32) may be changed in configuration. In the ionization part (32) of the present variation, the wave shape in the negative electrode member (37) is not limited to be rectangular, in other words the negative electrode member (37) may employ, as its wave shape, any shape including sine-wave shape, triangular wave shape et cetera. In the negative electrode member (37), the ionization line (35) is provided on one surface of the negative electrode member (37) situated on the pre-filter's (31) side, and the discharge electrode (41) is provided on another surface of the negative electrode member (37) on the catalytic filter's (34) side situated opposite to the one surface. The ionization line (35) is disposed at a "valley" portion when viewing the negative electrode member (37) from the pre-filter's (31) side, in other words the ionization line (35) is disposed inside a concave portion. On the other hand, the discharge electrode (41) is disposed at a "valley" portion when viewing the negative electrode member (37) from the electrostatic filter's (33) side, in other words the discharge electrode (41) is disposed inside a concave portion.

Third Variation

In the foregoing embodiments, the electrostatic filter (33) is used as an electrical dust collecting member. Alternatively, instead of using an electrostatic filter, a duct collecting plate, such as an electrode plate, may be used as an electrical dust collecting member.

Fourth Variation

Furthermore, in the foregoing embodiments, the catalytic filter (34), whose substrate supports thereon a plasma catalyst such as a catalyst of the manganese family, a catalyst of the precious metal family etc., is disposed downstream of the plasma generating device (40). However, instead of using the catalytic filter (34), an adsorptive processing member, whose substrate supports thereon an adsorbent such as activated carbon, zeolite etc., may be disposed downstream of the plasma generating device (40).

INDUSTRIAL APPLICABILITY

As has been described above, the present invention is useful with gas treating devices for removing dust, odors etc. present in the air by causing discharge to take place.

What is claimed is:

1. A gas treating device comprising:

a counter electrode;

a first discharge electrode configured to discharge between the first discharge electrode and the counter electrode to electrically charge dust in a gas to be treated;

an electrical dust collecting member configured and arranged for entrapping and collecting the electrically charged dust in the gas to be treated; and a second discharge electrode configured to discharge between the second discharge electrode and the counter electrode to generate a plasma for decomposing a component to be treated.

2. The gas treating device of claim 1, wherein the electrical dust collecting member is formed by an electrostatic filter.

3. The gas treating device of claim 1, further comprising a plasma catalyst activated by the plasma generated by the discharge between the second discharge electrode and the counter electrode to promotes the decomposition of the component to be treated.

4. The gas treating device of claim 1, wherein the first discharge electrode is formed into a linear shape extending along the counter electrode, and the second discharge electrode is electrically connected to a middle portion of the first discharge electrode, and is disposed such that a distance between the second discharge electrode and the counter electrode is shorter than a distance between the first discharge electrode and the counter electrode.

5. The gas treating device of claim 1, wherein the counter electrode has a columnar shape with a generally C-shaped cross section and at least the second discharge electrode is disposed inside the counter electrode.

6. The gas treating device of claim 1, wherein the counter electrode includes a corrugated, plate-shaped electrode member and the first discharge electrode is disposed on a side of one surface of the electrode member and the second discharge electrode is disposed on a side of the other surface of the electrode member, and the first discharge electrode and the second discharge electrode are disposed, respectively, inside concave portions of the corrugated, plate-shaped electrode member.

7. The gas treating device of claim 1, further comprising a photosemiconductor catalyst activated by the plasma generated by the discharge between the second discharge electrode and the counter electrode to promotes the decomposition of the component to be treated.

8. The gas treating device of claim 7, wherein the photosemiconductor catalyst is supported on the electrical dust collecting member.

9. The gas treating device of claim 3, wherein the plasma catalyst is disposed downstream of the second discharge electrode and the counter electrode, the electrical dust collecting member supports thereon a photosemiconductor catalyst that is activated by the plasma generated by the discharge between the second discharge electrode and the counter electrode to promotes the decomposition of the component to be treated, and the electrical dust collecting member is disposed between the second discharge electrode and the counter electrode, and the plasma catalyst.

* * * * *